US008276495B1

(12) United States Patent
Chiu et al.

(10) Patent No.: US 8,276,495 B1
(45) Date of Patent: Oct. 2, 2012

(54) MODULAR EXPLOSIVE ORDNANCE DISPOSAL SYSTEM

(75) Inventors: Peter Chiu, New York, NY (US); Hansen Lukman, Parsippany, NJ (US); Laurie A. Florio, West Orange, NJ (US); Brent Donahue, Newton, NJ (US); Kevin Russell, Jersey City, NJ (US); Eddy K. Tsui, Parsippany, NJ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 204 days.

(21) Appl. No.: 12/854,225

(22) Filed: Aug. 11, 2010

(51) Int. Cl.
*F42B 33/00* (2006.01)

(52) U.S. Cl. ..... 86/50; 89/7; 89/1.14; 42/1.08

(58) Field of Classification Search ..... 86/50; 89/7, 89/1.14; 42/1.08
See application file for complete search history.

(56) References Cited

U.S. PATENT DOCUMENTS

| | | | | | |
|---|---|---|---|---|---|
| 3,695,141 | A * | 10/1972 | Kronman et al. | ..... | 89/1.14 |
| 4,664,631 | A * | 5/1987 | Pederson et al. | ..... | 434/16 |
| 4,757,629 | A * | 7/1988 | Austin | ..... | 42/84 |
| 4,779,511 | A * | 10/1988 | Proctor et al. | ..... | 86/50 |
| 5,210,368 | A * | 5/1993 | Heller et al. | ..... | 86/50 |
| 5,386,758 | A * | 2/1995 | Conley | ..... | 86/50 |
| 5,460,154 | A * | 10/1995 | Mattern et al. | ..... | 124/56 |
| 5,743,246 | A * | 4/1998 | Mattern | ..... | 124/56 |
| 2009/0178548 | A1 * | 7/2009 | Tyas et al. | ..... | 86/50 |

* cited by examiner

*Primary Examiner* — Michael Carone
*Assistant Examiner* — Samir Abdosh
(74) *Attorney, Agent, or Firm* — Michael C. Sachs

(57) ABSTRACT

A kit of modular explosive ordnance disposal components may include five components. The five components may be assembled in various configurations to fire solid slugs, water shots, or fin-stabilized projectiles. Each assembled configuration may include a first component having a generally cylindrical shape, a through-bore, a muzzle end, and a breech end. The muzzle end of the first component may include external threads. The breech end of the first component may include an internally-threaded portion for receiving a .50 caliber breech plug. A .50 caliber cartridge chamber may be formed adjacent the internally-threaded portion. A bore of about one inch in diameter may extend from the .50 caliber cartridge chamber to the muzzle end of the first component.

6 Claims, 6 Drawing Sheets

MODULAR EXPLOSIVE ORDNANCE DISPOSAL SYSTEM

STATEMENT OF GOVERNMENT INTEREST

The inventions described herein may be manufactured, used and licensed by or for the U.S. Government for U.S. Government purposes.

BACKGROUND OF THE INVENTION

The invention relates to Explosive Ordnance Disposal (EOD) systems.

Three separate EOD systems may be used by the Army EOD community for firing solid slugs, water shot and fin-stabilized projectiles. The Mk2 may fire solid slugs. The Mk31 may fire solid slugs or water shot. The Mk40 may fire a fin-stabilized projectile. The Mk2, the Mk31, and the Mk40 may each use a .50 caliber electrically-actuated blank to provide the propulsive force for accelerating the chosen projectile.

The Mk2, the Mk31, and the Mk40 are three separate EOD systems having very little modularity between them. The Mk2 and the Mk31 may use a common breech plug. To fire water shot, solid slugs and fin-stabilized projectiles, the user must be equipped with at least two of the three EOD systems. A need exists for a light-weight, modular EOD system that may fire water shot, solid slugs and fin-stabilized projectiles.

SUMMARY OF THE INVENTION

It is an object of the invention to provide a light-weight, modular EOD system that may fire water shot, solid slugs and fin-stabilized projectiles.

One aspect of the invention is a kit of modular explosive ordnance disposal components. The kit may include a first component having a generally cylindrical shape, a through-bore, a muzzle end, and a breech end. The muzzle end may include external threads. The through-bore may include 1) an internally-threaded portion at the breech end for threadingly receiving a .50 caliber breech plug, 2) a .50 caliber cartridge chamber adjacent the internally-threaded portion, and 3) a bore of about one inch in diameter extending from the .50 caliber cartridge chamber to the muzzle end.

A second component may have a generally cylindrical shape, a through-bore, a muzzle end, and a support end. The muzzle end may include external threads. The through-bore of the second component may include 1) an internally-threaded portion at the support end for engaging the external threads of the muzzle end of the first component, and 2) a bore of about one inch in diameter extending from the internally-threaded portion at the support end to the muzzle end.

A third component may have a generally cylindrical shape, a through-bore, a muzzle end, and a support end. The through-bore of the third component may include 1) an internally-threaded portion at the support end for engaging the external threads of the muzzle end of the first component, 2) a first bore of less than one inch in diameter adjacent the internally-threaded portion, and 3) a second bore of about 40 millimeters in diameter extending from the first bore to the muzzle end.

A fourth component may have a generally cylindrical shape for fitting in the bore of the first component, a through-bore, an entrance end, and an exit end. The through-bore of the fourth component may include a converging-diverging nozzle with a diameter of the converging portion at the entrance end being smaller than a diameter of the diverging portion at the exit end. The diameter of the diverging portion at the exit end may be about a same diameter as the diameter of the first bore of the third component.

A fifth component may have a generally cylindrical shape, a through-bore, a first end, and a second end. The through-bore of the fifth component may include an internally-threaded portion at the first end for engaging the external threads at the muzzle end of the first component.

Another aspect of the invention is a method of firing a solid slug. The method may include assembling the first and fifth components of the kit of modular explosive ordnance disposal components.

A further aspect of the invention is a method of firing a water shot. The method may include assembling the first and second components of the kit of modular explosive ordnance disposal components and then, firing the water shot.

Another aspect of the invention is a method of firing a fin-stabilized projectile. The method may include assembling the first, third, and fourth components of the kit of modular explosive ordnance disposal components.

The invention will be better understood, and further objects, features, and advantages thereof will become more apparent from the following description of the preferred embodiments, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION OF THE PREFERRED EMBODIMENTS

A modular EOD system may be in the form of a kit that may contain several components. The components may be combined in various configurations. One configuration may have the functionality of the known Mk2, for example, the ability to fire solid slugs. Another configuration may have the functionality of the known Mk31, for example, the ability to fire solid slugs and water shot. A third configuration may have the functionality of the known Mk40, for example, the ability to fire fin-stabilized projectiles.

Figure 7:
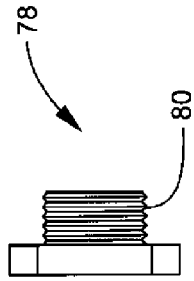
Fig. 7 Prior Art
FIG. 7 is a side view of a breech plug for the configurations of FIGS. 1-6.
Figure 8:
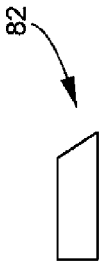
Fig. 8 Prior Art
FIG. 8 is a side view of a solid slug.
Figure 1:
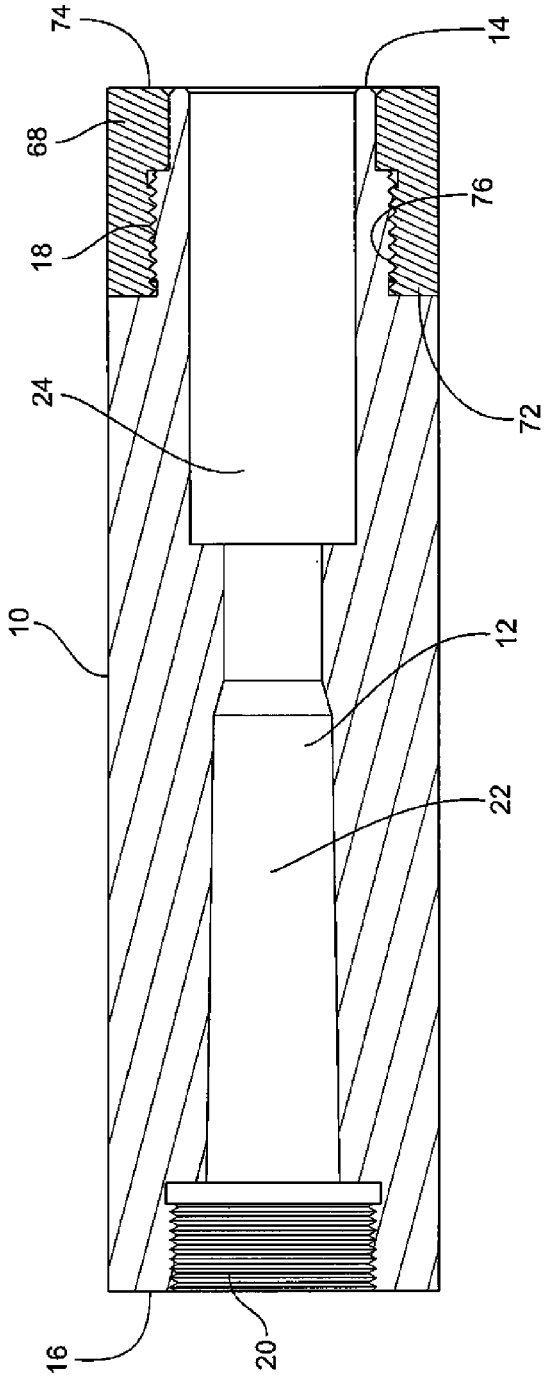
FIG. 1 is a side sectional view of a configuration of EOD components for firing a solid slug.
Figure 2:
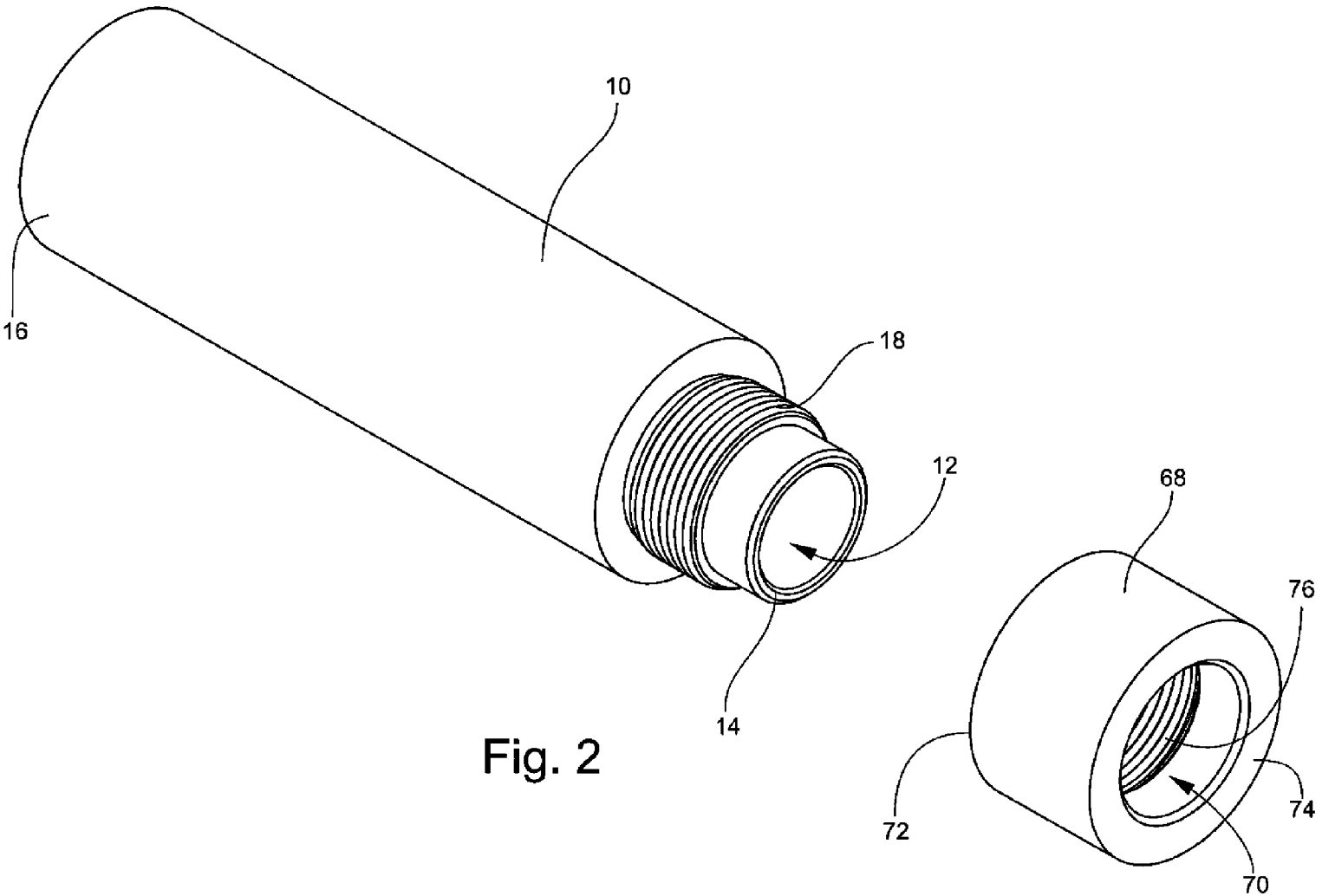
FIG. 2 is a perspective, exploded view of FIG. 1.

FIG. 1 is a side sectional view of a configuration of EOD components 10, 68 for firing a known solid slug 82 (FIG. 8). FIG. 2 is a perspective, exploded view of FIG. 1. The configuration of FIG. 1 includes EOD components 10 and 68. EOD component 10 may have a generally cylindrical shape, a through-bore 12, a muzzle end 14, and a breech end 16. Muzzle end 14 may include external threads 18. Through-bore 12 may include an internally-threaded portion 20 at the breech end 16 for receiving a known .50 caliber breech plug 78 (FIG. 7). Breech plug 78 may include external threads 80 for mating with internally-threaded portion 20 of component 10.

Referring again to FIG. 1, through-bore 12 may include a .50 caliber cartridge chamber 22 adjacent internally-threaded portion 20. Through-bore 12 may include a bore 24 of about one inch in diameter extending from .50 caliber cartridge chamber 22 to muzzle end 14.

The wall thickness and, therefore, the outer diameter, of component 10 may depend on its material of construction. The wall thickness may be calculated in a known manner to withstand the forces created by a .50 caliber blank fired in chamber 22. Component 10 may comprise, for example, titanium.

Because the distance from muzzle end 14 to a desired target may be only a few feet, the axial length of bore 24 may be small, for example, a few inches.

Component 68 (FIGS. 1 and 2) may have a generally cylindrical shape, a through-bore 70, a first end 72, and a second end 74. Through-bore 70 may include an internally-threaded portion 76 at first end 72, for engaging external threads 18 at muzzle end 14 of component 10. Component 68 may function as a thread guard for threads 18 of component 10.

Components 10 and 68 may provide a configuration for firing a solid slug 82 (FIG. 8). The manner of loading and firing a .50 caliber electrically-actuated blank with a solid slug 82 is known in the art.

Figure 9:
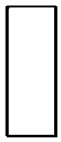
Fig. 9 Prior Art
FIG. 9 is a side view of a water shot.
Figure 3:
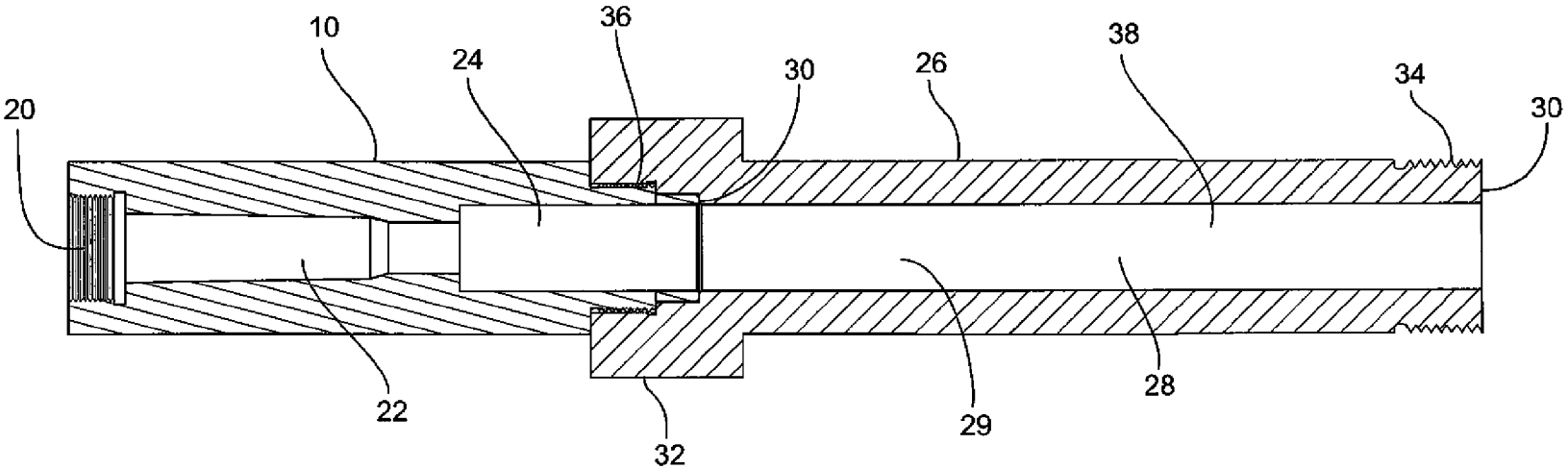
FIG. 3 is side sectional view of a configuration of EOD components for firing a solid slug or a water shot.
Figure 4:
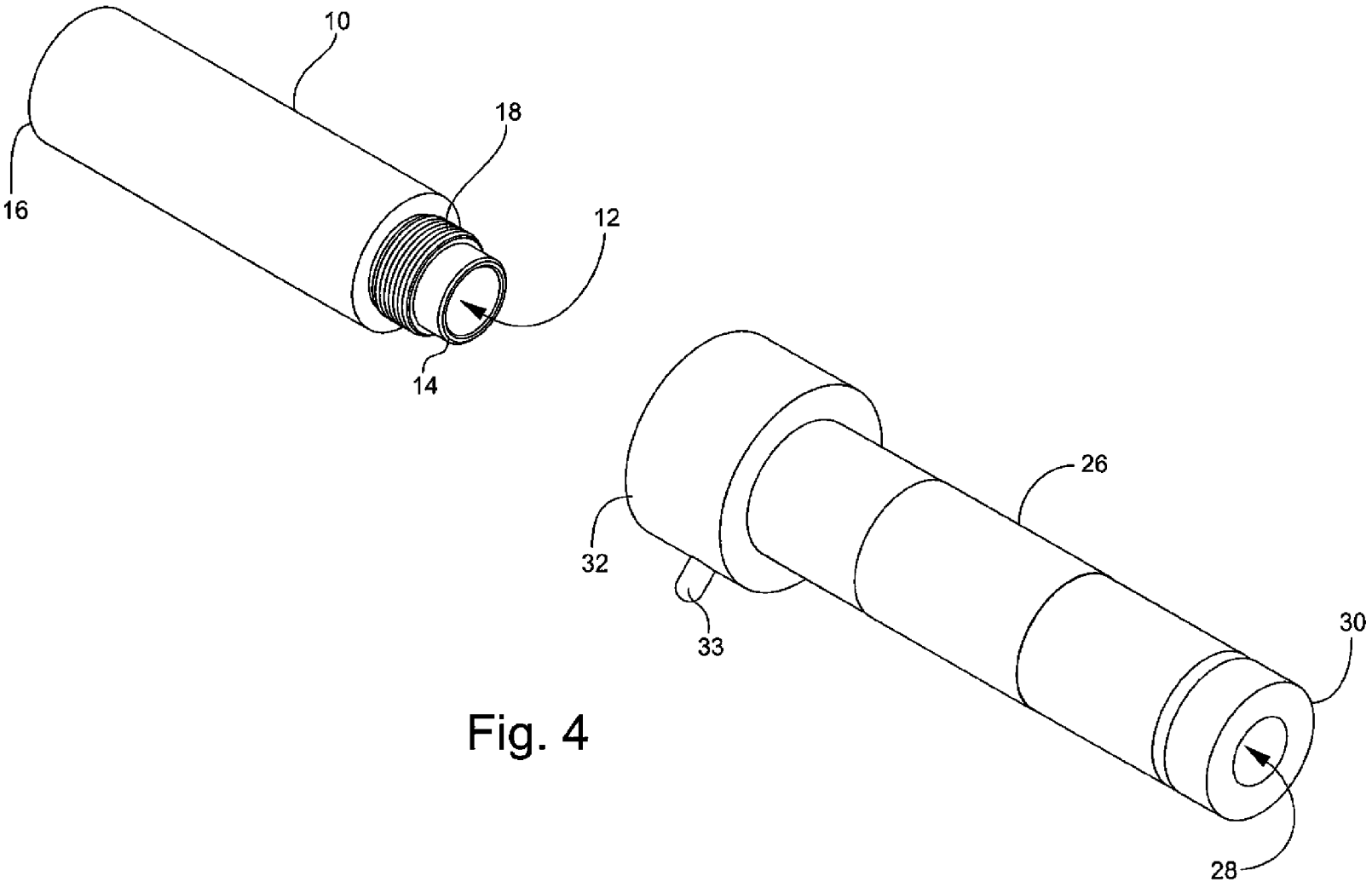
FIG. 4 is a perspective, exploded view of FIG. 3.

FIG. 3 is side sectional view of a configuration of EOD components 10, 26 for firing a solid slug 82 or a water shot 84 (FIG. 9). Water shot 84 may include water disposed in a plastic cartridge. FIG. 4 is a perspective, exploded view of FIG. 3.

Component 26 may have generally cylindrical shape, a through-bore 28, a muzzle end 30, and a support end 32. Muzzle end 30 may include external threads 34. External threads 34 may mate with the internal threads of a known water nozzle (not shown) or known solid slug nozzle (not shown). Through-bore 28 may include an internally-threaded portion 36 at support end 32 for engaging external threads 18 of muzzle end 14 of component 10. Through-bore 28 may include a bore 29 of about one inch diameter extending from internally-threaded portion 36 at support end 32 to muzzle end 30.

Because the distance from muzzle end 30 to a desired target may be only a few feet, the axial length of bore 29 may be small, for example, about seven to ten inches. The wall thickness and, therefore, the outer diameter, of component 26 may depend on its material of construction. The wall thickness may be calculated in a known manner to withstand the forces created by a .50 caliber blank fired from chamber 22 in component 10. Component 26 may comprise, for example, titanium.

Support end 32 of component 26 may include a projecting support 33 (FIG. 4). Projecting support 33 may be used to elevate component 26 above the ground a small amount.

Components 10 and 26 may provide a configuration for firing a solid slug 82 (FIG. 8) or a water shot 84 (FIG. 9). The manner of loading and firing a .50 caliber electrically-actuated blank with a solid slug 82 or water shot 84 is known in the art.

Figure 10:
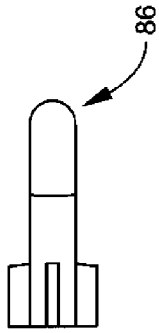
Fig. 10 Prior Art
FIG. 10 is a side view of a fin-stabilized projectile.
Figure 5:
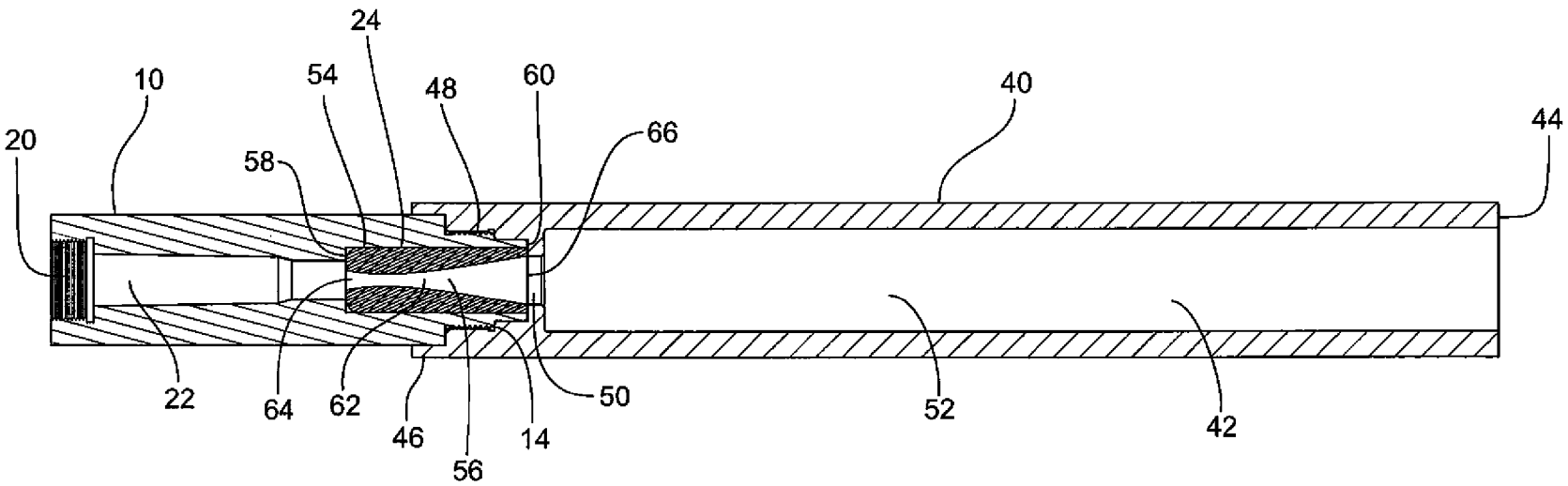
FIG. 5 is side sectional view of a configuration of EOD components for firing a fin-stabilized projectile.
Figure 6:
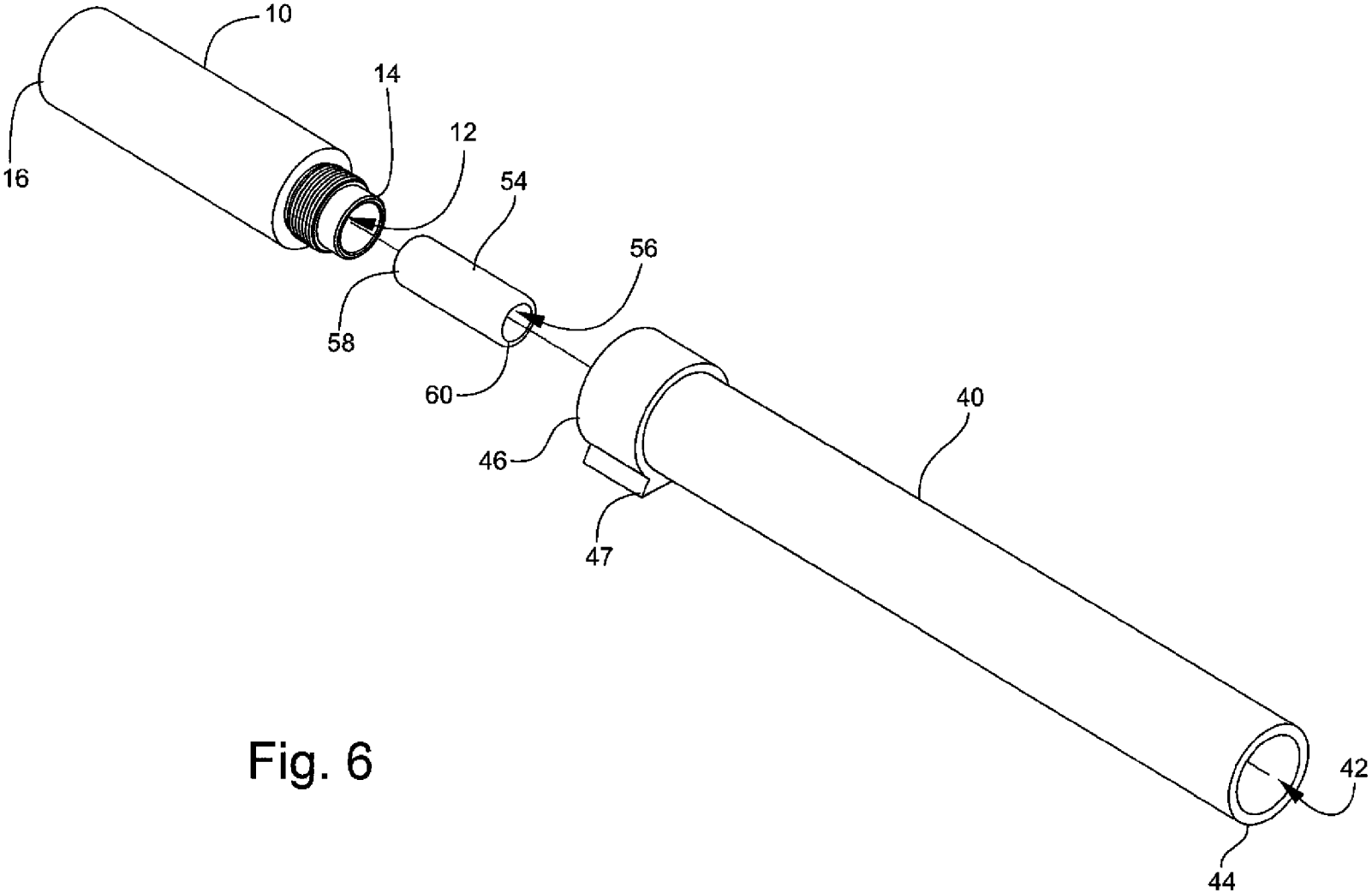
FIG. 6 is a perspective, exploded view of FIG. 5.

FIG. 5 is side sectional view of a configuration of EOD components 10, 40, and 54 for firing a fin-stabilized projectile 86 (FIG. 10). FIG. 6 is a perspective, exploded view of FIG. 5.

Component 40 may have generally cylindrical shape, a through-bore 42, a muzzle end 44, and a support end 46. Through-bore 42 may include an internally-threaded portion 48 at support end 46 for engaging external threads 18 of muzzle end 14 of component 10. Through-bore 42 may include a first bore 50 of less than about one inch in diameter. First bore 50 may be adjacent internally-threaded portion 48. Through-bore 42 may include a second bore 52 of about 40 millimeters in diameter. Second bore 52 may extend from first bore 50 to muzzle end 44.

Because the distance from muzzle end 44 to a desired target may be only a few feet, the axial length of second bore 52 may be small, for example, about eight to twelve inches. The wall thickness and, therefore, the outer diameter, of component 40 may depend on its material of construction. The wall thickness may be calculated in a known manner to withstand the forces created by a .50 caliber blank fired from chamber 22 in component 10. Component 40 may comprise, for example, titanium.

Component 54 may have a generally cylindrical shape for fitting in bore 24 (best seen in FIG. 1) of component 10. Component 54 may include a through-bore 56, an entrance end 58, and an exit end 60. Through-bore 56 may include a converging-diverging nozzle 62. A diameter of the converging portion 64 at entrance end 58 may be smaller than a diameter of the diverging portion 66 at exit end 60. The diameter of diverging portion 66 at exit end 60 may be about the same as the diameter of first bore 50 of component 40. Nozzle 62 may function as a combustion regulation nozzle to prevent a large pressure drop between components 10 and 40. Component 54 may comprise, for example, titanium.

In addition to the weight reduction resulting from the modularity of the invention, the weight of the modular EOD system may be further reduced by constructing the components of titanium. The modular EOD system may be over 55% lighter than the three combined legacy systems.

While the invention has been described with reference to certain preferred embodiments, numerous changes, alterations and modifications to the described embodiments are possible without departing from the spirit and scope of the invention as defined in the appended claims, and equivalents thereof.

What is claimed is:

1. A kit of modular explosive ordnance disposal components for selective use by a disposal expert in the field, comprising:

a first component having a generally cylindrical shape, a through-bore, a muzzle end, and a breech end, the muzzle end including external threads; the through-bore including 1) an internally-threaded portion at the breech end for threadingly receiving a .50 caliber breech plug, 2) a .50 caliber cartridge chamber adjacent the internally-threaded portion, and 3) a bore extending from the .50 caliber cartridge chamber to the muzzle end;

a second component having a generally cylindrical shape, a through-bore, a muzzle end, and a support end, the muzzle end including external threads; the through-bore including 1) an internally-threaded portion at the support end for engaging the external threads of the muzzle end of the first component, and 2) a bore extending from the internally-threaded portion at the support end to the muzzle end;

a third component having a generally cylindrical shape, a through-bore, a muzzle end, and a support end; the through-bore including 1) an internally-threaded portion at the support end for engaging the external threads of the muzzle end of the first component, 2) a first bore of less than one inch in diameter adjacent the internally-threaded portion, and 3) a second bore extending from the first bore to the muzzle end; and a fourth component having a generally cylindrical shape for fitting in the bore of the first component, a through-bore, an entrance end, and an exit end; the through-bore including a converging-diverging nozzle with a diameter of the converging portion at the entrance end being smaller than a diameter of the diverging portion at the exit end wherein the diameter of the diverging portion at the exit end is generally the same diameter as the diameter of the first bore of the third component, whereby said components may be drawn from said kit to perform disposal tasks by the disposal person.

2. The kit of claim 1, further comprising a fifth component having a generally cylindrical shape, a through-bore, a first end, and a second end; the through-bore including an internally-threaded portion at the first end for engaging the external threads at the muzzle end of the first component.

3. The kit of claim 1, wherein the four components comprise titanium.

4. The kit of claim 2, wherein the five components comprise titanium.

5. The kit of claim 1, wherein the second component includes a projecting support at its support end.

6. The kit of claim 1, wherein the third component includes a projecting support at its support end.

* * * * *